US006572064B1

(12) United States Patent
Letson et al.

(10) Patent No.: US 6,572,064 B1
(45) Date of Patent: Jun. 3, 2003

(54) REVOLVING TREE STAND

(76) Inventors: Harvey Letson, 27485 Sycamore Creek, Valencia, CA (US) 91354; Christopher C. Strong, 42273 Woodstone La., Quartz Hill, CA (US) 93536; Gail A. Hamilton-Strong, 42273 Woodstone La., Quartz Hill, CA (US) 93536

( * ) Notice: Subject to any disclaimer, the term of this patent is extended or adjusted under 35 U.S.C. 154(b) by 0 days.

(21) Appl. No.: 09/696,414

(22) Filed: Oct. 24, 2000

Related U.S. Application Data

(60) Provisional application No. 60/161,057, filed on Oct. 25, 1999.

(51) Int. Cl.[7] ..... A47B 95/00; A47G 33/12

(52) U.S. Cl. ..... 248/349.1; 248/521; 248/529; 47/40.5

(58) Field of Search ..... 248/349.1, 511, 248/519, 521, 522, 523, 527, 346.5; 47/40.5

(56) References Cited

U.S. PATENT DOCUMENTS

| | | | | | |
|---|---|---|---|---|---|
| 913,474 | A | * | 2/1909 | Dreibuss | 47/40.5 |
| 1,694,815 | A | * | 12/1928 | Garlick | 248/529 |
| 1,971,300 | A | * | 8/1934 | Garrett | 248/522 |
| 2,416,802 | A | * | 3/1947 | Roung | 47/40.5 |
| 2,605,067 | A | * | 7/1952 | Lindsell | 47/40.5 |
| 2,674,147 | A | * | 4/1954 | Franklin | 84/95.1 |
| 3,648,957 | A | * | 3/1972 | Bencriscutto | 248/544 |
| D257,529 | S | * | 11/1980 | Raap | D11/164 |
| 4,895,339 | A | * | 1/1990 | Yang et al. | 248/522 |
| 4,916,858 | A | * | 4/1990 | Hobson | 47/81 |
| 5,149,043 | A | * | 9/1992 | Grundmann | 248/349.1 |
| 5,492,301 | A | * | 2/1996 | Hauser | 248/516 |
| 5,779,309 | A | * | 7/1998 | Lu | 297/344.26 |
| 5,878,989 | A | * | 3/1999 | Allman | 248/522 |
| 5,893,547 | A | * | 4/1999 | Cohen, Jr. | 248/521 |
| 5,921,022 | A | * | 7/1999 | Baker | 47/40.5 |
| 6,102,357 | A | * | 8/2000 | Papadatos | 248/519 |
| 6,279,265 | B1 | * | 8/2001 | Scannell, Jr. | 47/79 |

* cited by examiner

*Primary Examiner*—Anita King
(74) *Attorney, Agent, or Firm*—Roger A. Marrs

(57) ABSTRACT

A revolving tree stand having a bucket into which the terminating end of a tree's trunk is inserted whereby a spike in the bucket retains the trunk in the bucket. Securement near the top of the bucket adjustably supports the tree in an upright and straight position. The bucket holds a quantity of water and a float indicator is employed for visually indicating water level. The bucket is rotatably mounted on a stationary support which incorporates roller bearings on which the bottom of the bucket rests. Therefore, rotation of the tree via the bucket is achieved by the bearings at the bottom of the bucket and, if desired, bearings at the top of the bucket. A stop may adjustably retain the bucket in a releasable fixed position,

3 Claims, 3 Drawing Sheets

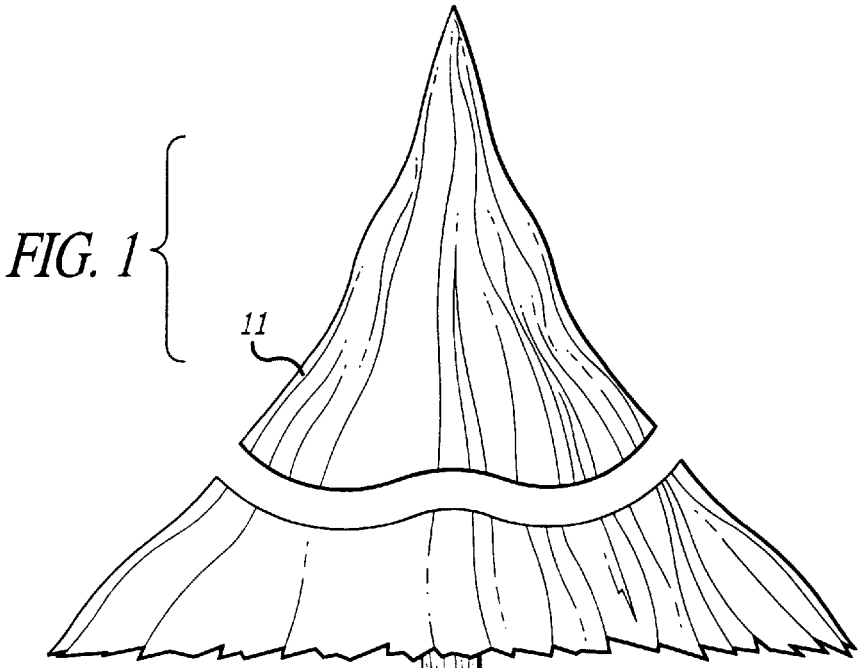
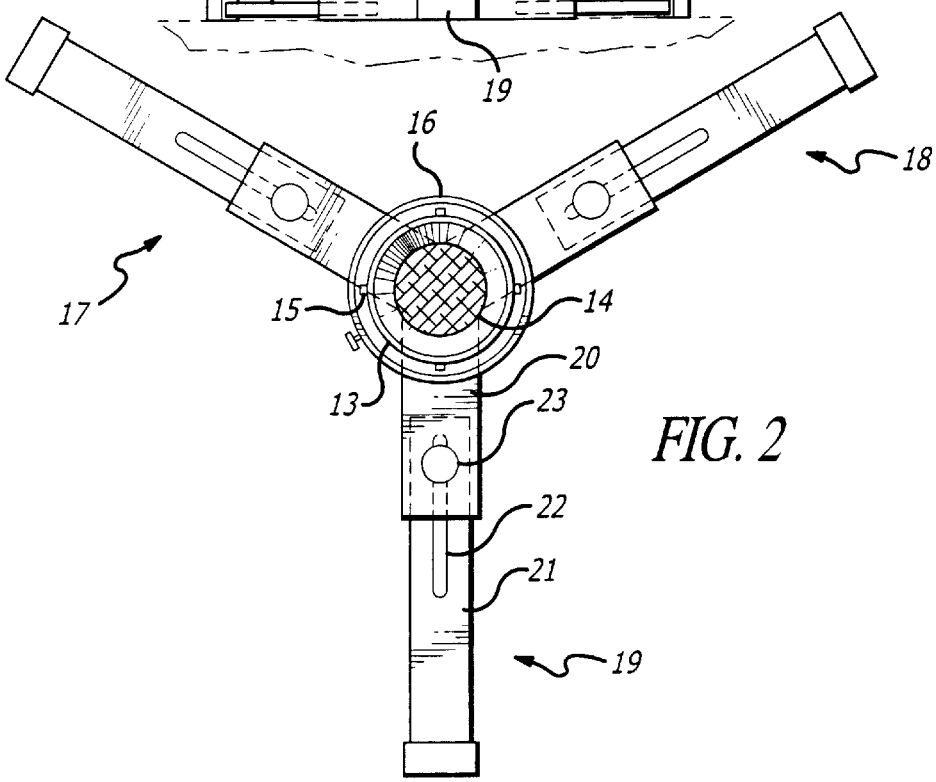
FIG. 2

FIG. 4
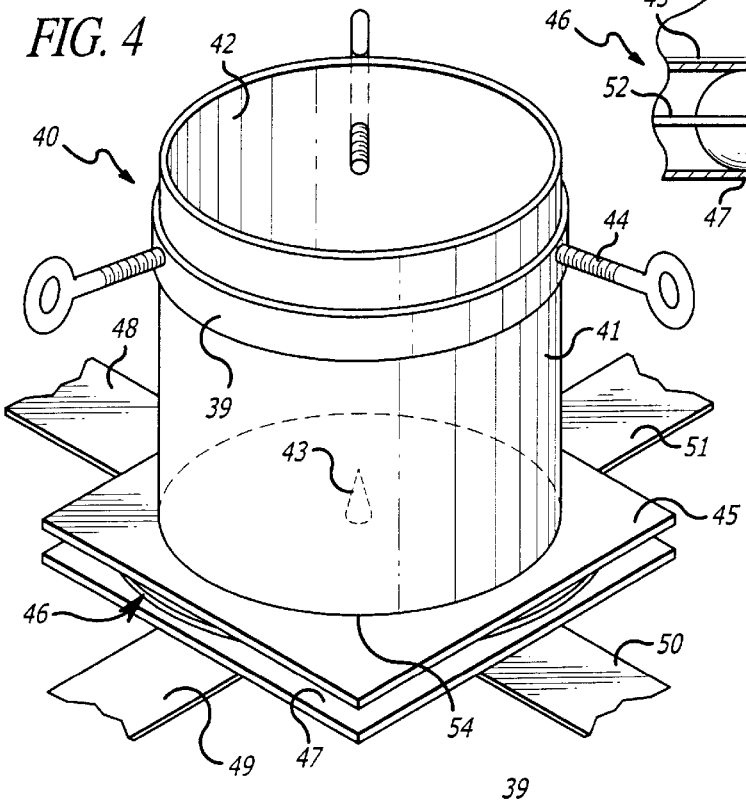
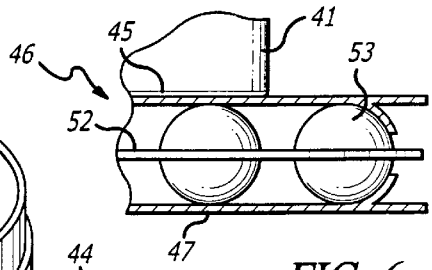
FIG. 6
FIG. 5
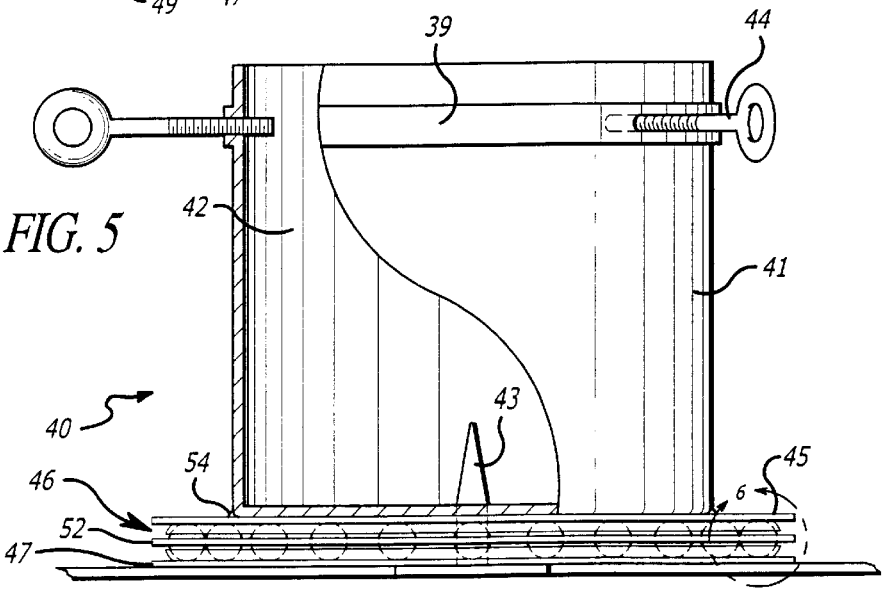

REVOLVING TREE STAND

This application claims benefit of application Ser. No. 60/161,057, filed Oct. 25, 1999.

BACKGROUND OF THE INVENTION

1. Field of the Invention

The present invention relates to the field of tree stands, and more particularly to a novel revolving tree stand having a bucket for supporting the trunk of the tree and wherein the bucket is rotatably supported in a bearing structure so that the tree may be selectively rotated during a tree decoration procedure and further having a retaining means for holding the tree in a fixed position at the completion of the decoration procedure.

2. Brief Description of the Prior Art

In the past, it has been the conventional practice to decorate a tree by stringing lights and other forms of decorative devices on the exterior of a tree. Usually the lights are provided in a string which is draped-around the periphery of the tree while other others, such as balls, religious articles or the like are clipped or looped over branches for detachable securement. During the practice of the decorating procedure, it would be helpful to rotate the tree in selected increments as the string of lights and other decorations are being placed on the branches so that a desired uniformity of decoration can be achieved. It is difficult to obtain such uniformity when manually draping and decorating the tree when it is placed in a position so that it is difficult to reach behind or in back of the tree.

In some instances, devices have been provided for locating the tree and such devices are usually employed in connection with rotating the tree while it is fully decorated and not necessarily for use during the decorating procedure. Examples of such prior rotating devices are disclosed in U.S. Pat. Nos. 5,893,547; 3,648,957; 1,694,815 and 913,474. Although such prior devices have been useful for their intended purpose, they fall short of an acceptable device for supporting the tree inasmuch as in some instances, electrical motors are employed which are to be avoided because of the possible causation of fires derived from short circuits or the like. Such occurrence may occur particularly when electrical motors are used and circuitry is adjacent water such as is sometimes used in connection with indoor decorated trees. Also, problems occur when electrical circuitry is employed due to contact corrosion as well as electrical shorting. In other instances, prior devices use a revolving support system which is not smooth since a great deal of friction may occur between rotating and non-rotating parts. Furthermore, when water is intended to be used with the device, most devices do not include any level indicator which would provide a visual indication to the user concerning the level or amount of water in the tree stand. Other problems occur since normally the tree stand support legs are not adjustable and do not lie flat on the surface on which the standed tree is supported whereby tipping problems may readily occur. Since, in some instances, it is desired to prevent the rotation of the tree after the decorative procedure has been completed, means must be provided to releasably retain the tree in a favored position.

In view of the foregoing, a long-standing need has existed to provide a revolving tree stand which will hold a limited amount of water and having a level indicator, all of which is supported on a revolving support which is adjustable depending on the size and weight of the tree intended to be placed in the stand.

SUMMARY OF THE INVENTION

Accordingly, the above problems and difficulties are avoided by the present invention which provides a novel revolving tree stand having a bucket into which the terminating end of a tree's trunk is inserted so that a spike in the bottom of the bucket engages with and retains the trunk in the bucket. Securement or retaining means are provided near the top of the bucket which can adjustably support the tree in an upright and straight position within the bucket. The bucket is of a diameter greater than the diameter of the tree trunk so that a quantity of water may be held inside the bucket and a float level indicator is carried in the water for visually indicating water level. The bucket is rotatably mounted in a stationary housing which incorporates roller bearings at its bottom on which the bottom of the bucket rests while the upper end of the housing mounts a bearing race with the inner race engaging with the walls of the bucket. Therefore, rotation of the tree via the bucket is achieved by means of the bearings at the bottom of the bucket and the mounting bearings at the top of the bucket. A stop means is adjustably provided between the housing and the bucket so that once positioned, the bucket can be held in a releasable fixed position. Further, the housing is carried on a triangular stand which includes at least three legs which include telescoping sections so that each leg may be adjusted in length with a detent or screw fastener adjustable to hold the extended length of the leg in position with respect to a socket portion of the leg.

Therefore, it is among the primary objects of the present invention to provide a novel revolving tree stand which may be selectively rotated in increments while the exterior of a tree is being decorated with a string of lights, decorations or the like.

Another object of the present invention is to provide a novel revolving tree stand which includes a bucket for holding a quantity of water into which the trunk of the tree is placed and which further includes a water level indicator and further, bearing support means for rotatably supporting the bucket on a fixed stand.

Still a further object of the present invention is to provide a novel revolving tree stand which includes a housing carried on a fixed stand and wherein a revolving bucket supporting the trunk of a tree is rotatably mounted whereby rotation may be achieved in either a clockwise or counterclockwise direction at the selection of a decorator who is stringing and placing decorations about the periphery of a tree.

A further object resides in providing a revolving means for holding a tree in a stand which includes adjustable retaining means for supporting the tree trunk and which includes a stop means for holding the means in a preferred position subsequent to a tree-decoration procedure.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view of a tree mounted in the novel revolving tree stand incorporating the present invention;

FIG. 2 is a top plan view of the tree stand illustrated in FIG. 1;

FIG. 4 is a front perspective view of another version of a revolving tree stand employing the present invention;

FIG. 5 is a side elevational view partially in section of the tree stand shown in FIG. 4; and FIG. 6 is an enlarged fragmentary, in section, of the bearing used in the tree stand of FIG. 5 as taken in the direction of arrows 6 thereof.

DESCRIPTION OF THE PREFERRED EMBODIMENT

Figure 3:
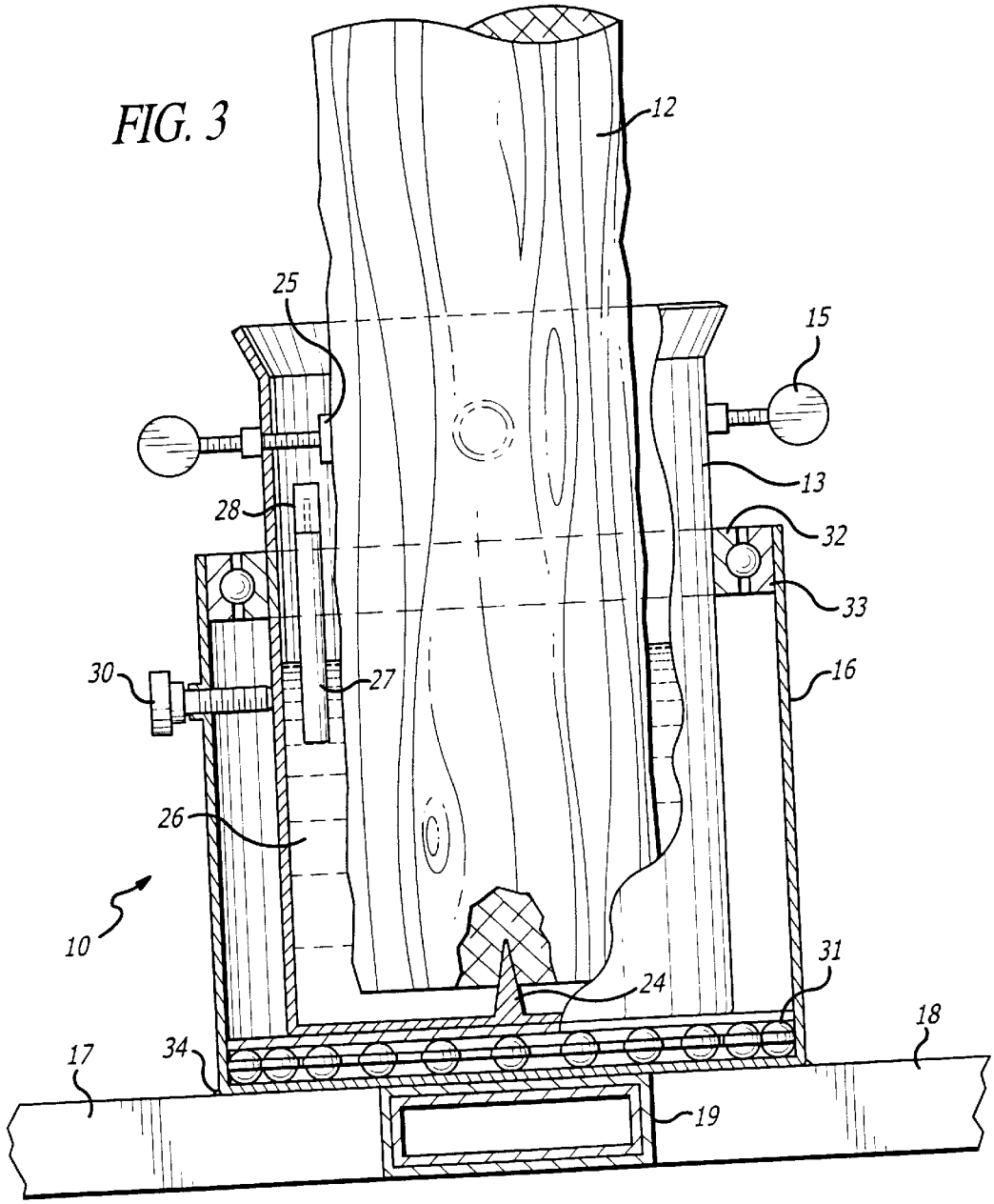
FIG. 3 is a longitudinal cross-sectional view of the revolving tree stand as illustrated in FIGS. 1 and 2.

The novel revolving tree stand incorporating the present invention is illustrated in the general direction of arrow 10 and is illustrated as supporting a tree 11 having a trunk 12 which is inserted into a bucket 13 having a flared open entrance 14 leading into the interior of the bucket. Adjustable fasteners, such as wing screws 15, are used for releasably supporting the trunk 12 in the bucket 13. The bucket 13, in turn, is rotatably carried in a housing 16 which is fixedly supported on a triangular base comprising legs 17, 18 and 19 respectively. Therefore, it can be seen that the tree 11 may be rotated in either a clockwise or counterclockwise direction since the trunk 12 and bucket 13 are rotatably carried in the housing 16.

With respect to FIG. 2, it can be seen that each of the respective legs 17–19 inclusive includes a base portion 20 which is preferably welded to the bottom of the housing 16 and includes an outwardly projecting section 21 which is adjustably carried within the base section 20 in a telescoping type connection. In one form, a slot 22 is provided in the extension section 21 through which a fastener 23 is coupled so that when the extension has been outwardly projected from the base portion 20, the fastener 23 can be tightened to maintain the extension in the fixed position. It is to be understood that each of the respective legs 17 and 18 is identical to the structure and description with respect to support leg 19.

Referring now in detail to FIG. 3, it can be seen that the trunk 12 has been inserted into the interior of the bucket 13 and that a spike 24 enters the bottom of the trunk to temporarily hold and support the trunk in the interior of the bucket. The trunk is retained in the bucket by means of the plurality of adjustment retainers 15 taking the form of wing nuts which are threadably engaged through the side wall of the bucket so that pads 25 bear against the trunk of the tree. Also, it can be seen that the interior of the bucket is substantially occupied by a quantity of water 26 and that a float 27 serves as an indicator as to the level of the water within the bucket. The bottom part of the float is weighted so that the upper part, indicated by numeral 28, is exposed above the surface so that a visual indicator is present. Furthermore, the rotation of the bucket with respect to the fixed housing 16 can be releasably prevented by means of a threaded screw 30 which will prevent rotation of the bucket with respect to the housing 16 at the selection of the user.

Of most importance is the feature that the bucket 13 is rollably supported on a bearing arrangement, indicated by numeral 31. This arrangement includes a plurality of ball bearings which are mounted in a race so that the entire arrangement rests on the bottom of the housing 16 and totally supports the bucket and tree. To further stabilize and permit rotation of the bucket and tree, an upper bearing arrangement is employed having a plurality of ball bearings disposed between an outer race 32 and an inner race 33. The inner race is fixed to the upper end of the housing 16 while the outer race is in an interference fit with the bucket 13. Therefore, the bucket and inner race can rotate with respect to the race 33 and housing 16.

Preferably, the leg supports are attached to the bottom of the housing 16 by suitable welds, such as weld 34 which extends around the entire bottom of the housing.

In view of the foregoing, it can be seen that the device of the present invention provides a means for rotatably moving a tree during a decorating procedure so that all sides of the tree can be readily decorated and that a selected side of the tree can be displayed at the selection of the user by employing the lock or stop 30. Water can be introduced at any time through the flared opening leading into the bucket and the water level is determined by the indicator 28. No electrical circuitry or motor means are needed to effect rotation and, therefore, the rotating device is safe and does not require any underwriter approvals or the like. The tree trunk is readily retained within the bucket 13 by the wing fasteners 15 and by employing the upper bearings and lower bearing arrangements, the bucket is not only supported but rotatably mounted with respect to the fixed or stationary housing 16. The legs 17–19 inclusive can be lengthened or shortened depending on the weight or size of the tree intended to be supported.

Referring to FIG. 4, another version of the present invention is illustrated in the general direction of arrow 40 which includes a cylindrical bucket or container 41 having an internal cavity 42 for insertably receiving the end of a tree trunk. An internal spike 43 is provided for embedding i too the base of the tree trunk and serves as a retainer for holding the trunk in the bucket or container. Also, a plurality of screw retainers, such as retainer 44, are provided and are threaded through a reinforcing band 45 adjacent to the top edge marginal region of the container 41. The band strengthens the side wall of the container and also serves to provide sufficient threads in openings to receive the threaded shank of the retainer 44.

The bottom of the bucket or container 41 is fixly carried on a plate 45, which in turn, rests on top of a bearing assembly represented by numeral 46. The underside of the bearing assembly rotatably mounts on a fixed platform or base 47 that is carried on stabilizing legs 48, 49, 50, and 51 respectively.

Referring now in detail to FIG. 5, the revolving tree stand 40 would seem to have an internal cavity 42 into which the terminating end of a tree trunk in insertably disposed so that the bottom surface of the trunk is gripped by the sharp point of the spike 43. Also, it can be seen that the plate 45 is carried on top of the ball bearing assembly 46 while the undersurface of the ball bearing assembly rides on the stationary plate 47. Preferably, the container 41 is composed of a heavy metal and the diameter of the cavity is such that the volume of the tree trunk occupies only a portion of the cavity so that a quantity of water can be introduced into the cavity. As described with respect to the embodiment shown in FIGS. 1–3, a water level indicator such as a float may be carried on the surface of the water to indicate level. The bottom of the container 41 can be welded to the revolving plate 45 by means of fillets 54.

Referring now to FIG. 6, it can be seen that the bearing assembly includes a retainer plate 52 which carries a plurality of ball bearings, such as bearing 53, between detentes which are formed from the retainer 52. The balls of the assembly can rotate within the detentes and the top of the ball rollably supports the revolving plate 43 while the lower portion of each ball in the assembly rests in a rollable manner on the fixed plate 47. Therefore, it can be seen that the bearing assembly rotably supports the plate 45 and the container 41 onto the stationary support 47 and legs 48–51 inclusive.

Therefore, it can be seen that when a tree is installed in the container 41, the tree and container can be rotated relative to the fixed or stationary base whereby the tree, including any decorations, can be placed in a selected or desired position. The construction of the revolving tree stand is robust so that relatively large and weighted trees can be accommodated. It is to be understood that the container can be reduced in size for smaller and less weighty trees.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A revolving tree stand comprising:

an open-top container having an internal cavity for receiving a tree trunk;

said container having a circular bottom having a peripheral edge upwardly supporting a cylindrical sidewall;

said bottom having an undersurface of a given diameter dimension and an inner surface within said internal cavity;

a first plate fixly secured to said undersurface and having an edge marginal region extending beyond said given diameter dimension of said undersurface;

a second plate arranged in fixed, spaced-apart parallel relationship with respect to said first plate to define a space therebetween;

a ball bearing assembly operably disposed in said space for rollably supporting said first plate and said container on said second plate;

said bearing assembly having a retainer plate with a plurality of pairs of detentes wherein each pair of detentes movably captures a ball so that a portion of each ball resides above and below said retainer plate so as to be in rollable engagement with opposing surfaces of said first plate and said second plate;

said internal cavity holds a quantity of water as a reservoir for said tree trunk;

said second plate constituting a stationary base and includes at least four outwardly projecting and spaced-apart legs fixly and permanently attached thereto; and a spike mounted on said inner surface of said bottom of said container in coaxial relationship with respect to said cylindrical sidewall for releasably retaining said tree trunk.

2. The tree stand defined in claim 1 wherein:

each detente of said pair of detentes is integrally constructed in said retainer plate.

3. A revolving tree stand comprising:

a stationary base;

an open-top container having a given diameter dimension and having an internal cavity for receiving a tree trunk;

means carried on said container for releasably retaining said tree trunk in said internal cavity;

bearing means operatively disposed between said container and said stationary base permitting said container to rotate with respect to said stationary base;

said bearing means includes a bucket having a greater diameter dimension than said given diameter dimension of said container and further having a circular retainer plate with a plurality of ball bearings disposed on said retainer plate wherein said container including said tree trunk is rotatably disposed with respect to said bucket;

a spike carried on said container for securing said tree trunk and at least one thumb screw retainer engageable with said tree trunk; and said container includes a cylindrical sidewall having an edge marginal region mounting said thumb screw retainer and further having a bottom with an inside surface coaxially mounting said spike and an outside surface engageable with said plurality of ball bearings.

* * * * *